United States Patent [19]

Sugie

[11] Patent Number: 4,482,175

[45] Date of Patent: Nov. 13, 1984

[54] LOCKING DEVICES

[75] Inventor: Syuichi Sugie, Tokyo, Japan

[73] Assignees: Kabushiki Kaisha Isshin Kenkyusho; Tokyo Magnet Ohyo Seihin Kabushiki Kaisha, both of Tokyo, Japan

[21] Appl. No.: 464,021

[22] Filed: Feb. 4, 1983

[51] Int. Cl.[3] ..... E05C 19/02

[52] U.S. Cl. ..... 292/45; 292/198; 292/DIG. 4; 292/DIG. 72

[58] Field of Search ..... 292/45, 191, 192, 341.18, 292/341.19, 229, 216, 198, DIG. 4, DIG. 72

[56] References Cited

U.S. PATENT DOCUMENTS 1,509,780 9/1924 Robertson ..... 292/DIG. 4
4,383,707 5/1983 Nishimura ..... 292/DIG. 4

FOREIGN PATENT DOCUMENTS 1188996 4/1970 United Kingdom ..... 292/DIG. 4

*Primary Examiner*—Richard E. Moore
*Attorney, Agent, or Firm*—Carroll F. Palmer

[57] ABSTRACT

Locking devices for kitchen doors, drawers or like closure structures comprise a locking mechanism fixed to the cabinet supporting the door and a key unit mounted on the door. The locking mechanism includes a heart-shaped groove having a recess in which a projecting member in the device lodges under spring bias when the device is in the locked position. Operation of the devices to lock a door is achieved by pushing the door toward the cabinet so the key unit engages the locking mechanism and the projecting member moves in the heart-shaped groove until it lodges in the recess to firmly lock the door. Opening such a locked door is achieved by first pushing the door further closed so that the key unit enters deeper into the locking mechanism to cause the projecting member to disengage from the recess which then allows the door to move forward to an unlocked position. Several embodiments of the devices are disclosed.

4 Claims, 5 Drawing Figures

LOCKING DEVICES

SUMMARY OF THE INVENTION

The present invention relates to a locking device for opening or closing a door which is used in kitchen furniture and the like.

Kitchen furniture for accommodating tableware and kitchen utensils is usually installed below or above a sink or a cooking range. Therefore, one must stretch oneself or bend down to open or close the door of such kitchen furniture, so that the door cannot be reliably opened or closed. However, the door must be surely locked to prevent entrance of insects and to maintain necessary hygienic conditions.

In accordance with one aspect of the present invention, a locking device for opening or closing a door is provided which comprises a lock mechanism and a key unit; said lock mechanism being mounted in an appropriate position on a kitchen furniture box and including a lock housing having a pair of holes formed in the front surface thereof, a slider which can slide within the lock housing, a pair of clamps, one end of each of which is pivotally mounted on the slider, and the outer free end of each of which has a spring force acting outward, the clamps being movable in the holes, a groove having a heart-shaped contour formed in the slider, and a projecting member which can slide in the groove and which provides back pressure; and said key unit being mounted on the door to oppose the lock mechanism and comprising a spherical member for clamping between the clamps and a supporting seat for adjustably supporting the spherical member.

When the door begins to be closed, the spherical member provided in the key unit is clamped between the pairs of clamps of the lock mechanism. While most conventional lock mechanisms merely have holes formed in predetermined positions to receive the spherical member, the lock mechanism according to the present invention additionally has clamps for clamping it. Therefore, even if the door has some play, the spherical member can be reliably held. Furthermore, since the spherical member is adjustably supported by the supporting seat, the clamping positional relationship between the clamps and the spherical member can be readily and accurately adjusted.

Then, as the door is further closed, the clamps which clamp the spherical member therebetween slide into the lock housing thereby moving the slider. The projecting member situated in the pointed end of the groove of the slider is guided along the heart-shaped groove, and is then engaged with a recess formed in a position corresponding to the cups of the heart and momentarily stopped. In this state, the door is locked. When the door is to be opened, the door is slightly pushed to move the projecting member out of the recess, and the door is then opened by pulling the door. Since the heart-shaped groove gradually increases in depth in the direction of the sliding movement of the projecting member, the projecting member which has been once moved out of the recess during the opening operation of the door is prevented from returning through the recess. In this manner, the lock mechanism according to the present invention locks the door by the spherical member of the key unit being pulled into the lock mechanism, so that the door can be reliably opened or closed.

In accordance with another aspect of the present invention, a locking device for opening or closing a door is provided which comprises a lock housing having an inlet and an outlet, and grooves formed on respective outer surfaces of the lock housing to communicate with the inlet and the outlet and which gradually increase in depth from an inlet and to an outlet end; and a key unit on which is pivotally mounted a forked hook which has a spring force to urge branches thereof inward and a spring force to constantly keep the forked hook in parallel to the axis. The lock mechanism and the key unit are mounted on a box and the door to oppose each other. When the door is closed, the branches of the forked hook are inserted into the groove through the inlet. Since the hook has a spring force to urge its branches inward, it reliably slides along both grooves. The hook then slides along the heart-shaped contour, and is momentarily stopped at an indentation or recess which is in a position corresponding to the cups of the heart. The door is locked in this state. Then, when the door is slightly pushed again, the hook is moved out of the recess and slides along the rest of the heart-shaped contour toward the outlet. The hook is eventually pulled out of the outlet, so that the door is opened. Since the groove gradually increases in depth from its inlet end to its outlet end, the hook will never return to the inlet. In addition, since the hook has a spring force which acts in parallel with its axis, it extends in parallel with the axis when the hook is stopped at the recess of the heart-shaped contour and thus the door is reliably locked.

The hook can be more securely held in the recess, when an urging pin which provides back pressure is provided in the lock housing such that it can project from the front side thereof. More particularly, when the door begins to be closed, the rear surface of the door abuts against the end of the urging pin. When the door is further closed against the urging force of the urging pin, the door is constantly urged in the direction to open. In this state, the bottom of the recess of the heart-shaped contour, the forked hook is urged upon reaching therein, so that the engagement of the hook in the recess becomes more stable and therefore the locking operation of the door is ensured. On the other hand, when the door is to be opened, it can be smoothly opened due to the spring force acting in the direction as described above. Furthermore, even if the door has some play, a reliable locking operation is achieved.

Other objects, effects and features of the present invention will be apparent from the following description of the embodiments of the present invention with reference to the accompanying drawings.

The illustrated embodiments do not limit the scope of the present invention, and the scope of the present invention is limited only by the attached claims.

Figure 1:
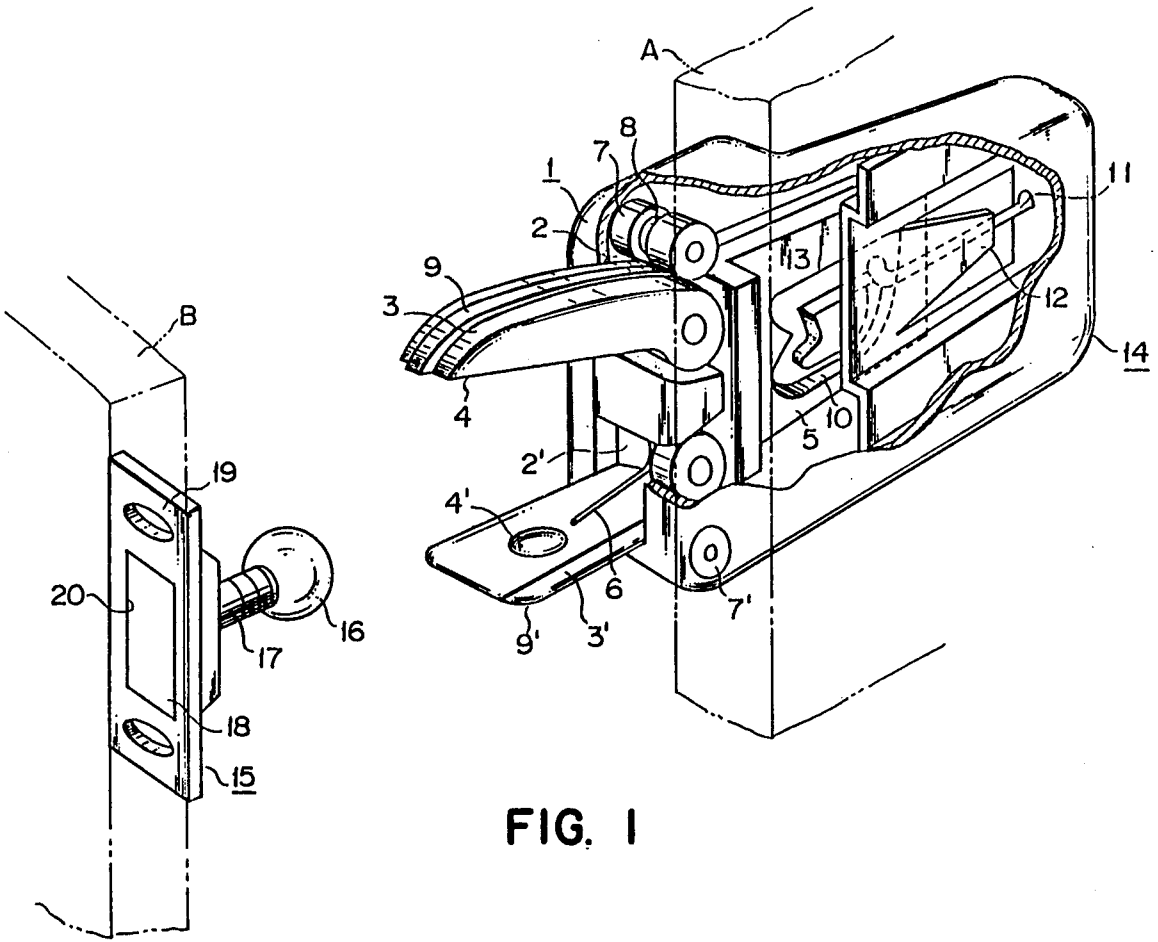
FIG. 1 is a perspective view showing a first embodiment of the present invention.

A first embodiment of the present invention will be described below with reference to FIG. 1 and FIG. 2.

A lock housing 1 is made of a relatively hard synthetic resin or a cast metal. A pair of holes 2 and 2' are formed in the upper and lower portions of the front side of the locking housing 1. A pair of clamps 3 and 3' are movably fitted into the holes 2 and 2', respectively. The free front ends of the clamps 3 and 3' have hemispherical recesses 4 and 4' in their opposing surfaces, respectively, while the rear ends thereof are pivotally mounted on the front end face of a slider 5 which is provided in the lock housing 1 and which can slide along the axis of the housing 1. A spring member 6 is attached at its middle portion to an appropriate part of the lock housing 1. The ends of the spring member 6 extend along the opposing surfaces of the clamps 3 and 3'. In this arrangement, the clamps 3 and 3' are respectively urged outward, that is, in the direction to increase the distance between their free ends. A pair of rollers 7 and 7' provided on the upper and lower portions of the front side of the locking housing 1 have annular grooves 8 and 8' in the respective middle portions thereof. A pair of rails 9 and 9' are provided along the outer surfaces of the clamps 3 and 3' and are engaged in the grooves 8 and 8', respectively. When the clamps 3 and 3' are moved toward the interior of the lock housing 1, the rollers 7 and 7' urge the clamps 3 and 3' toward each other to reduce the distance between the free ends thereof.

A groove 10 having a heart-shaped contour is provided in the slider 5 in the vertical plane thereof. A horizontal U-shaped projecting member 11 is inserted at its one end into the rear (pointed) portion of the groove 10, when the door is open (FIG. 1). The other end of the projecting member 11 is attached to an appropriate part of the lock housing 1. A leaf spring 12 appropriately provided in the lock housing 1 serves to urge the projecting member 11 from the rear end thereof so as to keep that end of the projecting member which is inserted into the groove 10 in constant contact with the bottom of the groove 10. When the leaf spring 12 urges the rear side of the projecting member 11 as shown in FIG. 1, the distal end of the projecting member 11 can be smoothly inserted into the groove 10. The depth of the groove is preferably relatively small between the upper side of the heart-shaped contour and a recess 13 formed by a pair of cups of a central ridge, and is preferably relatively large between the recess 13 and the lower side thereof. A lock mechanism 14 of the structure described above is mounted in contact with the front side of a box A for accommodating kitchen items. A key unit 15 is provided on the rear side of a door B of the kitchen furniture opposite to the lock unit 14. A spherical member 16 is attached to a horizontal rod 17 in such a manner that the total length of the spherical member 16 and the horizontal rod 17 can be adjusted. The spherical member 16 is engaged with the opposing recesses 4 and 4' on the clamps 3 and 3' of the lock mechanism 14. The rear end of the rod 17 is fixed to a rectangular fixing plate 18, which is movably engaged with and supported on a rectangular recess 20 in a supporting seat 19 which is attached to the door B.

When the door B begins to be closed, the surface of the support seat 19 of the key unit 15 first abuts against the ends of the clamps 3 and 3' of the lock mechanism 14 to urge the clamps within the lock housing 1. The clamps 3 and 3' are guided due to engagement of their rails 9 and 9' with the annular grooves 8 and 8' of the rollers 7 and 7' provided on the housing 1, and are urged inward against the urging force of the spring member 6. Then, the spherical member 16 of the key unit 15 situated between the clamps 3 and 3' becomes clamped between the recesses 4 and 4'. In this manner, since the spherical member 16 is almost forcibly inserted into the recesses 4 and 4', the spherical member 16 can be kept in an appropriate position, even if the door has some play and the key member 15 is slightly misaligned with respect to the lock mechanism 14.

As the door B is further closed, the slider 5 slides in the housing 1 in cooperation with the clamps 3 and 3' Consequently, the end of the projecting member 11 engaged in the groove 10 slides along the upper side of the groove 10 to reach the recess 13 in the central ridge. Since force is always applied by the spring member 6 so as to separate the free ends of the pair of clamps 3 and 3', the end of the projecting member is momentarily stopped at the bottom of the recess 13. In this manner, the door B 11 is locked to the box A. In this state, when the closing force acting on the door is released, the door is kept in the locked state.

When the door B is to be opened, it is first slightly pushed so that the end of the projecting member 11 is moved out of the recess 13 of the groove 10. Then, when the door B is pulled to be opened, the end of the projecting member 11 reaches the lower side of the heart-shaped groove 10. Since the depth of groove 10 downstream of the recess 13 is greater than that upstream of the recess 13, the end of the projecting member 11 is prevented from returning to the upstream side. The restoring force of the spring member 6 causes the clamps 3 and 3' to return to their respective initial positions, and consequently, the slider 5 also returns to its initial position.

A second embodiment of the present invention will be described below with reference to FIG. 3 and FIG. 4.

Figure 2:
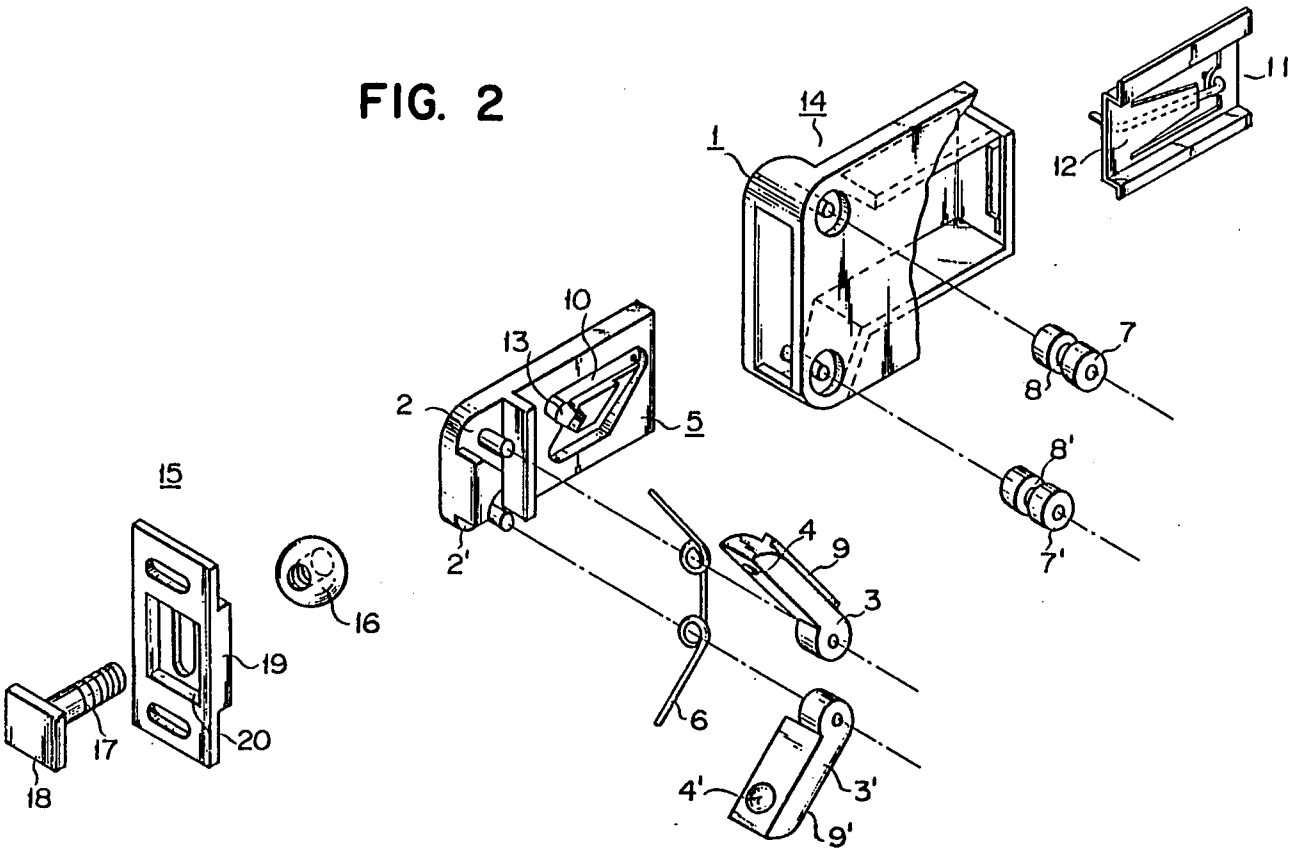
FIG. 2 is an exploded view of the first embodiment.

A lock housing 1A is also made of a relatively hard synthetic resin or a cast metal as in the embodiment shown in FIG. 1. Grooves 200 and 200' having a substantially heart-shaped contour are formed between an intermediate wall 300 and the two outer surfaces respectively of the lock housing 1A. Both ends of each groove 200 and 200' are open to provide an inlet 400 and an outlet 500 for a forked hook, as described below. Therefore, a recess 600 of a substantially heart-shaped central ridge is formed in the grooves 200 and 200'. The inlet 400 is arranged in such a manner that a bottom surface 400' of the inlet 400 is situated below the horizontal axis of the lock housing 1A.

Figure 5:
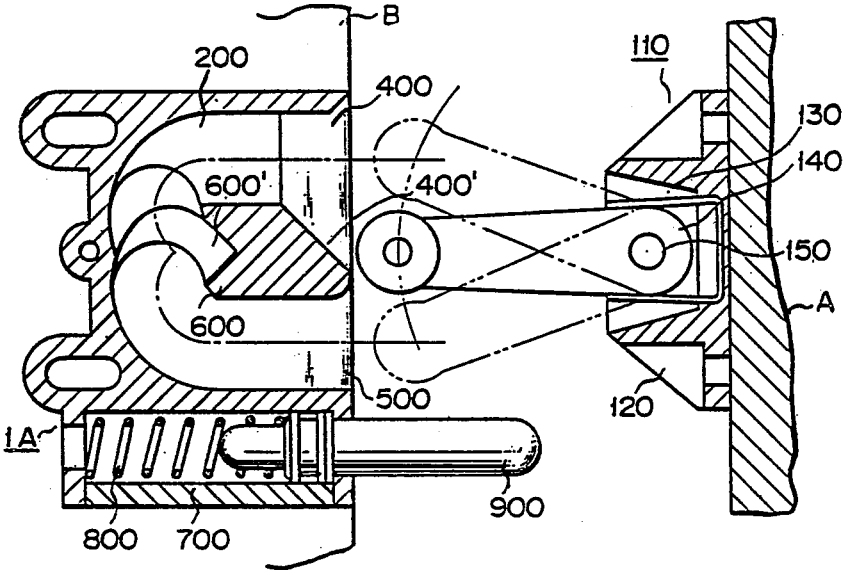
FIG. 5 is a partially sectional view showing the relative relationship between the lock mechanism and the key unit of the second embodiment.

The depth of the grooves 200 and 200', that is, the thickness of the intermediate wall 300, is gradually varied from the inlet end to the outlet end. More particularly, as shown in FIG. 3 and FIG. 5, their depth is gradually reduced from the inlet 400 toward the shallowest middle portion of the groove. Then, the left hand portions (as shown in the figures) are deepened slightly, the left hand portion of the lock housing 1A providing a deeper recess 600' formed between a pair of cups 600. The deepest portion of the grooves is situated at the left hand end of the lower side thereof and this depth is maintained up to the outlet 500.

Figure 3:
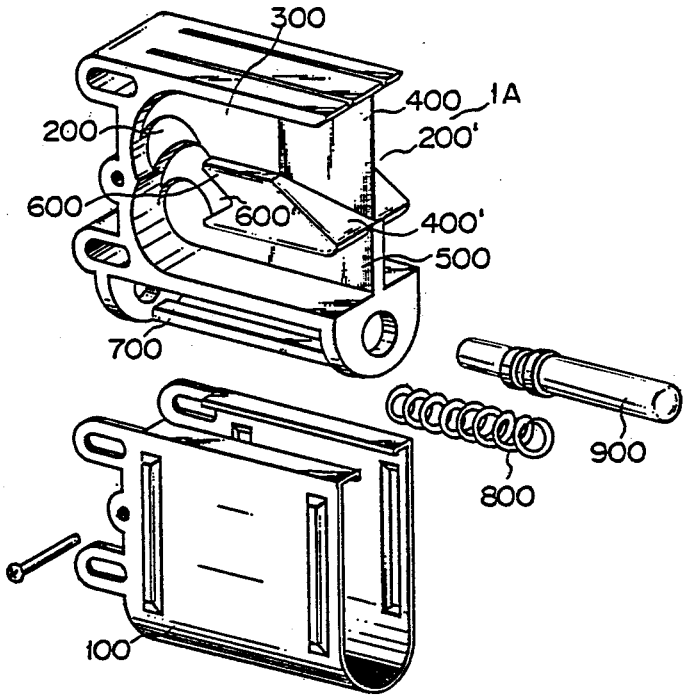
FIG. 3 is an exploded view of a lock housing of a second embodiment of the present invention.
Figure 4:
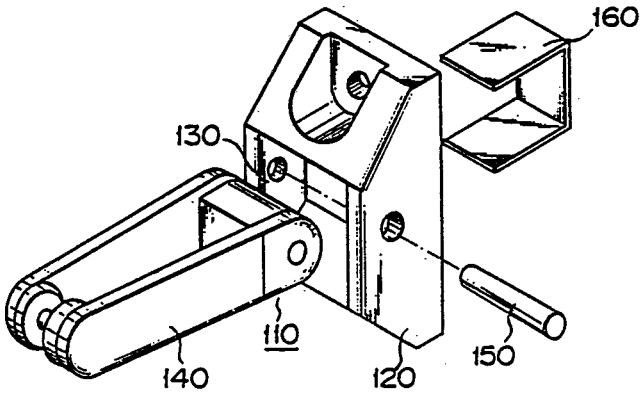
FIG. 4 is an exploded view of a key unit of the second embodiment.

In FIG. 3 and FIG. 5, a blind hole 700 is provided in the lower portion of the housing 1A in parallel with the horizontal axis thereof. The blind hole 700 accommodates an urging pin 900 to which the back pressure of a coil spring 800 is exerted. The urging pin 900 constantly projects from the inlet/outlet side of the lock housing 1A.

A cover 100 for covering the lock housing 1A is appropriately secured to the lock housing 1A. This assembly is mounted to an appropriate part of the front side of a kitchen furniture box in such a manner that the inlet 400 and the outlet 500 face front.

A key unit 110 is arranged opposite to the lock mechanism, and a projecting supporting seat 120 is secured on the rear side of a door A of the kitchen furniture box. A frustoconical blind hole 130 is formed on the horizontal axis of the supporting seat 120, and the enlarged-diameter end of the blind hole 130 is open to the lock mechanism. A U-shaped leaf spring 160 is accommodated in the blind hole 130. A horizontal U-shaped forked hook 140 is inserted at its rear portion into the blind hole 130, and is rotatably mounted on the supporting seat 120 by a pin 150 arranged horizontally within the leaf spring 160. The forked hook 140 has a spring force to urge the front ends of the branches thereof inward toward each other and can be inserted into the grooves 200 and 200' of the lock housing 1A.

When the door A begins to be closed, the rear surface of the door A first abuts against the end of the urging pin 900. When the door A is further moved against the urging force of the urging pin 900, the door A remains subjected to the urging force acting in the direction in which it is opened. Then, the forked hook 140 of the key unit 110 enters the grooves 200 and 200' of the lock unit through the inlet 400. The lock mechanism arranged to oppose the key unit 110 and the bottom surface 400' of the inlet 400 is situated below the axes of the lock housing 1A and the key unit 110. A spring force is exerted on the forked hook 140 by the U-shaped leaf spring 160 arranged behind it, so as to keep the hook 140 in parallel with the axes. Therefore, the hook 140 can reliably enter the inlet 400. In addition, the spring force is applied to urge the branches of the forked hook 140 inward, so that the hook in contact under pressure with the walls of the grooves 200 and 200' through the intermediate wall 300 can slide along the contour of the grooves 200 and 200'. As the door A is further closed, the end of the hook 140 slides along the grooves 200 and 200' beyond the cup 600 of the heart-shaped contour to reach the recess 600'. In this state, since the door A is always urged by the urging pin 900 in the direction to open, as described above, the forked hook 140 is forcibly engaged in the recess 600' and is stopped there. In this manner, the door A is locked. Then, when the door A is to be opened, it is slightly pushed so that the end of the forked hook 140 is moved out of the recess 600' and slides along the downstream portion of the grooves toward the outlet 500. Since the depth of the grooves 200 and 200' gradually increases from the inlet 400 through the recess 600' to the outlet 500, the forked hook 140 will never return to the inlet 400. Thereafter, the hook 140 is pulled out of the outlet 500 and the door A is opened. The opening operation is performed smoothly, because the door A is urged open by the back pressure of the urging pin 900.

What is claimed is:

1. A locking device for opening or closing a door, comprising a lock housing having an inlet and an outlet on a front side thereof, and grooves having a substantially heart-shaped contour which are formed on respective outer surfaces of said lock housing to communicate with said inlet and said outlet and which gradually increase in depth from an inlet end to an outlet end thereof; and a key unit on which is pivotally mounted a forked hook which has a spring force to urge branches thereof inward and a spring force to keep said forked hook in parallel with an axis thereof, said lock housing and said key unit being mounted on a box and said door to oppose each other, said forked hook being moved into said grooves through said inlet when said door is closed and then being stopped in a recess formed in said heart-shaped contour to lock said door, engagement of said forked hook in said recess being released when said door is opened so that said forked hook can be moved out through said outlet.

2. A locking device according to claim 1, wherein an urging pin which provides back pressure is provided in said lock housing and, when said door is closed, constantly urges said door in a direction to open said door.

3. A locking device for opening or closing a door of a cabinet comprising a lock mechanism and a key unit, said lock mechanism including:

a lock housing having a pair of holes in the front surface thereof, a slider slidable in said lock housing, a pair of clamps of an overall V-shape, said clamps being spring biased to an opened position and being reciprocal in said holes, a groove formed in said slider of heart-shaped contour having a recess portion, and a projecting member which tracks in said groove during movement of said slider and lodges in said recess when said device reaches a locked position;

said key unit including:

a spherical member which can be clamped between said pair of clamps, and a support for said spherical member that allows axially adjustment of said spherical member relative to said clamps, said lock mechanism and said key unit being mounted on said cabinet and on said door opposed to each other so that said spherical member of said key unit will move between said clamps of said lock mechanism upon closing of said door.

4. A locking device of claim 3 wherein the depth of said groove in the direction distal of said key unit is greater in its portion through which said projecting member exits therefrom than in tis portion through which said projecting member passes to lodge in said recess.

* * * * *